US005288554A

United States Patent [19]

Susa et al.

[11] Patent Number: 5,288,554

[45] Date of Patent: Feb. 22, 1994

[54] ABRASIVE FILAMENTS AND PRODUCTION PROCESS THEREOF

[75] Inventors: Tomoo Susa, Iwaki; Seiichi Ohira, Kitaibaraki; Hiroyuki Endo, Iwaki, all of Japan

[73] Assignee: Kureha Kagaku Kogyo K.K., Japan

[21] Appl. No.: 28,489

[22] Filed: Mar. 9, 1993

Related U.S. Application Data

[62] Division of Ser. No. 722,390, Jun. 26, 1991, Pat. No. 5,238,739.

[51] Int. Cl.[5] ..... D02G 3/00

[52] U.S. Cl. ..... 428/364; 428/372; 428/421; 525/199; 51/298; 51/293

[58] Field of Search ..... 525/199; 428/364, 372, 428/421; 51/298, 293; 44/44.98

[56] References Cited

U.S. PATENT DOCUMENTS

| | | | |
|---|---|---|---|
| 3,707,592 | 12/1972 | Ishii et al. . | |
| 4,302,556 | 11/1981 | Endo et al. | 525/199 |
| 4,353,960 | 10/1982 | Endo et al. | 43/44.98 |
| 4,386,132 | 5/1983 | Dille et al. | 43/44.93 |
| 4,546,158 | 10/1985 | Mizuno et al. . | |
| 4,627,950 | 12/1986 | Matsui et al. . | |
| 4,629,654 | 12/1986 | Sasaki et al. . | |
| 4,670,527 | 6/1987 | Mizuno . | |
| 4,833,027 | 5/1989 | Ueba et al. . | |
| 5,238,739 | 8/1993 | Susa et al. | 428/372 |

FOREIGN PATENT DOCUMENTS

| | | | |
|---|---|---|---|
| 0133001 | 2/1985 | European Pat. Off. . | |
| 3330511 | 11/1984 | Fed. Rep. of Germany . | |
| 2546097 | 2/1983 | France . | |
| 59-224268 | 11/1984 | Japan . | |
| 60-1146 | 1/1985 | Japan . | |
| 60-104514 | 6/1985 | Japan | 525/199 |
| 61-6279 | 2/1986 | Japan . | |

*Primary Examiner*—Patrick J. Ryan
*Assistant Examiner*—N. Edwards
*Attorney, Agent, or Firm*—Lowe, Price, LeBlanc & Becker

[57] ABSTRACT

Abrasive filaments made of a composition which comprises 95–70 vol.% of a polyvinylidene fluoride resin, whose inherent viscosity ($\eta_{inh}$) ranges from 0.9 to 1.4, and 5–30 vol.% of abrasive grains. They are produced by melt-spinning the composition and then stretching the resultant filaments at a draw ratio of 2.5 times–5.5 times within a temperature range of 100–200° C.

5 Claims, 1 Drawing Sheet

ABRASIVE FILAMENTS AND PRODUCTION PROCESS THEREOF

This application is a divisional, application of application Ser. No. 07/722,390, filed Jun. 26, 1991, now U.S. Pat. No. 5,238,739.

FIELD OF THE INVENTION

This invention relates to abrasive filaments (bristles) excellent in toughness, flexing fatigue resistance, warm water resistance, chemical resistance, and formability and processability, and more specifically to abrasive filaments made of a composition of a polyvinylidene fluoride resin, whose inherent viscosity ($\eta_{inh}$) falls within a specific range, and abrasive grains and having superb abrasiveness and durability, as well as to a process for their production.

BACKGROUND OF THE INVENTION

In the field of industrial abrasives, it is a well-known technique to use as abrasive filaments which are made of a synthetic resin and abrasive grains mixed and dispersed in the synthetic resin.

As synthetic resins for abrasive filaments, polyamides such as nylon 6, nylon 66 and their copolymers are used primarily. Besides, polyesters such as polyethylene terephthalate (PET), polybutylene terephthalate (PBT) and their copolymers as well as their mixtures are also employed.

In general, a mixture of one or more of such synthetic resins and one or more kinds of various abrasive grains is formed into filaments. The filaments are then bound together to use same as an abrasive brush.

Japanese Patent Laid-Open NO. 76279/1986 discloses abrasive bristles composed of nylon 610 and abrasive grains. Japanese Patent Laid-Open No. 224268/1984 discloses abrasive monofilaments which are composed of PBT as a main component, a small amount of a polyamide, and abrasive grains. Further, Japanese Patent Publication No. 1146/1985 discloses a composition with improved cutting and polishing ability, which is formed of a thermoplastic resin selected from polyamides and polyesters, a small amount of an ethylene-vinyl acetate copolymer and abrasive grains.

When a metal surface is polished by means of abrasive filaments, the polishing work is performed while feeding warm water or an acidic warm water to the metal surface so as to eliminate resulting frictional heat and maintain the metal surface clean.

Conventional abrasive filaments made of a polyamide as a principal component however absorb water due to the inherent water absorption property of the polyamide in the course of polishing work, so that they are caused to swell. As a result, they are softened to reduce their abrasiveness. In particular, they are prone to deterioration with an acidic warm water so that the percentage of broken filaments (broken loss percentage) increases. As has been mentioned above, polyamide-base abrasive filaments are accompanied by drawbacks that their abrasiveness is reduced to a considerable extent under ordinary polishing work conditions and their durability is also inferior.

It is hence necessary to perform such a cumbersome operation that in accordance with quality and performance changes of such polyamide-base abrasive filaments in the course of polishing work, the revolutionary speed of the abrasive brush is increased or the pressing force is increased to enhance the abrasiveness.

On the other hand, polyester-base abrasive filaments have better waterproofness compared with polyamide-base abrasive filaments. Abrasive filaments making use of PET involve problems that their stiffness is too high to give high abrasiveness and their durability is inferior because PET is hydrolyzed and becomes brittle when used for a long period of time. Although abrasive filaments making use of PBT have suitable stiffness and high abrasiveness, but they are accompanied by problems that they have inferior flexing fatigue resistance and tend to be flattened, they are hence also inferior in durability and their performance as an abrasive is reduced very fast.

OBJECTS AND SUMMARY OF THE INVENTION

An object of this invention is to provide abrasive filaments made of a synthetic resin, which contains abrasive grains, and having excellent abrasiveness and high durability.

Another object of this invention is to provide from a polyvinylidene fluoride resin abrasive filaments balanced highly in toughness, flexing fatigue resistance, warm water resistance, chemical resistance, formability and processability and also to provide a process for their production.

The present inventors have carried out an extensive investigation with a view toward providing solutions to the aforementioned problems of the prior art. As a result, it has been found that the above objects can be attained by mixing abrasive grains with a polyvinylidene fluoride resin having an inherent viscosity ($\eta_{inh}$) in a specific range and then melt-spinning the resultant mixture, leading to completion of this invention.

In one aspect of this invention, there is thus provided abrasive filaments made of a composition which comprises 95–70 vol.% of a polyvinylidene fluoride resin, whose inherent viscosity ($\eta_{inh}$inh) ranges from 0.9–1.4, and 5–30 vol.% of abrasive grains.

In another aspect of this invention, there is also provided a process for the production of abrasive filaments, which comprises:

melt-spinning a composition of 95–70 vol.% of a polyvinylidene fluoride resin, whose inherent viscosity ($\eta_{inh}$) ranges from 0.9 to 1.4, and 5–30 vol.% of abrasive grains; and stretching the resultant filaments at a draw ratio of 2.5 times–5.5 times within a temperature range of 100°–200° C.

DETAILED DESCRIPTION OF THE INVENTION

Figure 1:
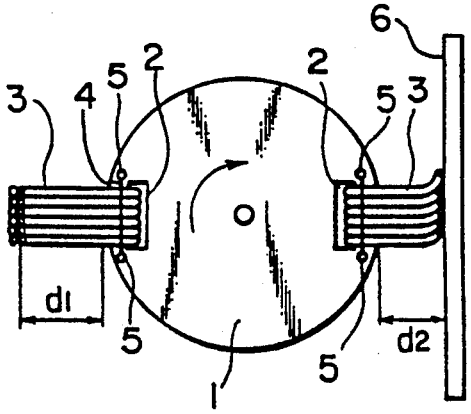
FIG. 1 is a simplified schematic view of an apparatus adapted to measure the repeated flexural fatigue (broken loss percentage) of abrasive filaments.

Features of the present invention will hereinafter be described in detail.

POLYVINYLIDENE FLUORIDE RESIN

The polyvinylidene fluoride resin (will hereinafter be abbreviated as "PVDF resin") useful in the practice of this invention is a polyvinylidene fluoride homopolymer or a copolymer of a vinylidene fluoride as a principal component, or a blend composed principally of either one of the homopolymer and copolymer. The copolymer is a copolymer composed of at least 70 mole % of vinylidene fluoride monomer and not more than 30 mole % of a monomer copolymerizable with vinylidene fluoride monomer, for example, a vinyl halide monomer such as ethylene tetrafluoride, ethylene monochloride trifluoride, propylene hexafluoride or vinyl fluoride. Especially, a copolymer containing a copolymerizable monomer in an amount up to 5 mole % may be used preferably.

The PVDF resin employed in the present invention must have an inherent viscosity ($\eta_{inh}$) in the range 0.9–1.4.

The inherent viscosity ($\eta_{inh}$) is a value measured at a PVDF resin concentration of 0.4 g/dl and a temperature of 30° C., using dimethylformamide as a solvent.

A PVDF resin having an inherent viscosity ($\eta_{inh}$) of 0.9–1.4 is used in the present invention, because such a PVDF resin is excellent in formability and processability such as extrudability, spinnability and stretchability and can provide filaments having excellent abrasiveness. In addition, filaments making use of such a PVDF resin are excellent in waterproofness, acid resistance, flexing fatigue resistance and the like.

The inherent viscosity ($\eta_{inh}$) must be at least 0.9 dl/g, with 1.0 dl/g–1.3 dl/g being preferred. Any inherent viscosity smaller than 0.9 dl/g will result in brittle abrasive filaments with more voids, thereby leading to a reduction to the elongation at break. On the other hand, any inherent viscosity in excess of 1.4 dl/g will result in a reduction to the melt formability (melt extrudability and melt spinnability).

PVDF resins usable in the present invention ranges from those having a high melting point to those having a low melting point. The term "high melting-point PVDF resin" as used herein means those having a melting point ($T_{m1}$) in the range of 165° C.–185° C. On the other hand, the term "low melting-point PVDF resin" as used herein means those having a melting point ($T_{m2}$) in the range of 125° C.–170° C. The distinction between a high melting-point PVDF resin and a low melting-point PVDF resin is a relative distinction.

In the present invention, high melting-point PVDF resins may each be used singly as a PVDF resin whose inherent viscosity ($\eta_{inh}$) ranges from 0.9 to 1.4. It is also feasible to use a polymer blend of a high melting-point PVDF resin and a low melting-point PVDF resin. The inherent viscosity ($\eta_{inh}$) of such a polymer blend is also required to fall within the range of 0.9–1.4.

The present invention requires the use of a high melting-point PVDF resin whose inherent viscosity ($\eta_{inh}$) ranges from 0.9 to 1.4, because such a high melting-point PVDF resin can provide filaments having excellent formability, processability and abrasiveness and good repeated flexural fatigue (broken loss percentage) and containing fewer voids.

When a high melting-point PVDF resin and a low melting-point PVDF resin are used in combination as a polymer blend, it is preferable to choose them in such a way that the following relationship is satisfied regarding their melting points:

$$50^\circ\ C. \geqq (T_{m1} - T_{m2}) \geqq 5^\circ\ C.$$

It is more preferable that the following equation is satisfied:

$$40^\circ\ C. \geqq (T_{m1} - T_{m2}) \geqq 10^\circ\ C.$$

When a high melting-point PVDF resin and a low melting-point PVDF resin are used in combination as a polymer blend, formability and processability such as extrudability, spinnability and stretchability are improved further compared with the use of a single high melting-point PVDF resin, whereby filaments having improved repeated flexural fatigue can be obtained. If the difference in melting point between both resins is too small, the resultant polymer blend will not be able to exhibit the above-mentioned effects. If the difference is too large conversely, the formability and processability will be reduced and the resulting filaments will be too soft to provide good abrasiveness. Neither an unduly small nor an excessively large melting point difference is therefore preferred.

When a polymer blend of a high melting-point PVDF resin and a low melting-point PVDF resin is used, the suitable proportion of the high melting-point PVDF resin is less than 100 wt.% but not less than 20 wt.%, preferably 99–50 wt.%, more preferably 80–50 wt.% and the appropriate proportion of the low melting-point PVDF resin is greater than 0 wt.% but not greater than 80 wt.%, preferably 50–1 wt.%, more preferably 50–20 wt.%.

If the proportion of the low melting-point PVDF resin should exceed 80 wt.%, the flexural stiffness, flex life, toughness and abrasiveness of filaments will be reduced. Any proportions greater than 80 wt.% are hence not preferred. If the content of the low melting-point PVDF resin should be 0 wt.%, neither formability nor processability will be improved. When the proportion of the low melting-point PVDF resin is within the range of 1–50 wt.%, most preferably, the range of 20–50 wt.%, it is possible to obtain filaments having a smaller broken loss percentage, fewer voids and a high degree of abrasiveness owing to excellent formability and processability and a suitable degree of flexibility. When the proportion of the low melting-point PVDF resin amounts to 50–80 wt.%, filaments having good formability and processability and a smaller broken loss percentage will be obtained but voids tend to occur around abrasive grains upon stretching, thereby resulted in reduced external appearance and durability in some instances.

ABRASIVE GRAINS

Any abrasive grains, which have been employed in conventional filaments such as nylon or polyester filaments, are usable as abrasive grains in the present invention. No particular limitation is imposed on the abrasive grains useful in the practice of this invention. As specific examples, may be mentioned alumina-type abrasives, silicon carbide abrasive, zirconia-type abrasives and natural abrasives by way of example. They may be used either singly or in combination. The preferable particle size of the abrasive grains may be #60–#500, notably, #80–#320 as measured in accordance with JIS-R6001. Any particle size greater than #60 may result in a resin composition having reduced spinnability and in filaments having lowered toughness. On the other hand, any particle size smaller than #500 will lead to filaments having reduced abrasiveness. Such excessively large or small particle size is hence not preferred.

MIXING OF PVDF RESIN AND ABRASIVE GRAINS

The mixing proportions of the PVDF resin and abrasive grains are 95–70 vol.%, preferably, 90–80 vol.% of the PVDF resin and 5–30 vol.%, preferably, 10–20 vol.% of the abrasive grains. If the mixing proportion of the abrasive grains should exceed 30 vol.%, filament breakage, void formation and reduced external appearance will occur. If the mixing proportion of the abrasive grains should be smaller than 5 vol.%, the resulting filaments will not have sufficient abrasiveness.

Upon production of the filaments of this invention, no particular limitation is imposed on the manner of mixing of the PVDF resin and abrasive grains. The following methods may be mentioned as specific examples. (1) All components are mixed together at once, followed by pelletization. (2) Two kinds of PVDF resins of different melting points are mixed and then pelletized. Thereafter, the resultant pellets are mixed with abrasive grains, followed by pelletization. (3) After mixing abrasive grains with a coupling agent which serves to bind a PVDF resin with the abrasive grains, the PVDF resin is mixed further, followed by pelletization. (4) Abrasive grains are mixed with a portion of a PVDF resin and the resultant mixture is pelletized. The remaining portion of the PVDF resin is then mixed with the thus-obtained pellets, followed by pelletization. Besides performing melt-spinning subsequent to the production of a pelletized mixture, it is possible to perform melt-spinning by charging, as is, a powdery mixture of a PVDF resin and abrasive grains in a spinning machine. Either one of these melt-spinning methods may be used.

The PVDF resin or the composition of the PVDF resin and abrasive grains may also contain one or more of routine additives such as heat stabilizer, antioxidant, weatherproof stabilizer, colorant, lubricant, nucleating agent, flame retardant, antistatic agent and various coupling agents, as desired.

PRODUCTION PROCESS OF FILAMENTS

The production of filaments may be performed by melt-spinning a composition of a PVDF resin and abrasive grains by means of an ordinary extruder, cooling the resulting filaments, stretching them at an elevated temperature and then thermally fixing the thus-stretched filaments. In the present invention, it is preferable to conduct the melt-spinning at 200–300° C., after cooling, to perform the stretching at a draw ratio of 2.5–5.5 times within a temperature of 100°–200° C. and then to carry out the thermal fixing at a temperature of 60° C. or higher.

The stretching temperature may be 100°–200° C., 140°–180° C. being preferred. If filaments are stretched at a stretching temperature lower than 100° C., voids be formed at the time of the stretching so that the resultant filaments tend to become brittle. On the other hand, any stretching temperature higher than 200° C. will result in fusing-off of filaments or even if such fusing-off will not occur, will result in a failure in providing filaments having good toughness. To achieve the above stretching temperature, may be followed either a wet method making glycerin or the like as a heating medium or a dry method employing hot air, far-infrared rays, high-frequency heating or the like.

The draw ratio may be 2.5–5.5 times, with 2.8–4.5 times being preferred. If the draw ratio should be smaller than 2.5 times, marks of necking will remain in filaments to be formed thereby to fail to provide filaments having a uniform diameter. If the draw ratio should exceed 5.5 times, the resulting filaments will be split off near abrasive grains so that they will become brittle and their abrasiveness will be reduced.

The thermal fixing is performed subsequent to the stretching by holding filaments under tension at 60° C. or higher, preferably 60°–120° C., most preferably about 85° C. in hot water. The stiffness and dimensional stability of filaments can be increased.

No particular limitation is imposed on the diameter of the filaments, but 0.1–3 mmϕ is generally suitable. If the diameter of filaments should be smaller than 0.1 mmϕ, the abrasiveness will be reduced. Any diameter greater than 3 mmϕ will result in filaments having reduced formability and processability and uneven abrasiveness. Filament diameters outside the above range are hence not preferred.

The cross-section of the filaments may have any shape such as circle, oval, triangle, rectangle, square or cylindrical.

ADVANTAGES OF THE INVENTION

The present invention can provide abrasive filaments having excellent abrasiveness and durability owing to the use of a PVDF resin having the specific inherent viscosity as a synthetic resin for the abrasive filaments. In particular, the abrasive filaments according to this invention are highly balanced in toughness, broken loss percentage (flexing fatigue resistance), warm water resistance, acid resistance, chemical resistance, formability and processability, abrasiveness, etc.

EMBODIMENTS OF THE INVENTION

The present invention will hereinafter be described specifically by the following Examples and Comparative Examples. The present invention will however not be limited to the following Examples.

First of all, the measuring methods of melting points and other values of physical values in the present invention will be described.

Measurement of Melting Points

The melting point (Tm) of each PVDF resin in the present invention is a value measured by the following method.

Measuring Apparatus

Differential scanning calorimeter (DSC-7) (manufactured by Perkin-Elmer Corp.).

Measuring Method

About 10 mg of a sample (particles, powder) was sealed within an aluminum sample pan. The pan with the sample sealed therein was set on the differential scanning calorimeter. The temperature was then raised at a rate of 10° C./minute from 30° C. to 200° C. (first heating). After reaching 200° C., the temperature was immediately brought down at a rate of 10° C./minute. After cooling the temperature down to 30° C., the temperature was immediately raised at a rate of 10° C./minute (second heating). The peak temperature of the endothermic fusion of crystals in the second heating was recorded as a melting point (Tm).

Repeated Flexural Fatigue (Broken Loss Percentage)

Measuring Apparatus

Shown in FIG. 1.

Measuring Method

Slots 2,2 of 4 mm wide and 9 mm long were formed through a disk 1 made of SUS-316 and having a diameter of 90 mmϕ and a thickness of 1.5 mm. Fourteen sample filaments 3 (diameter: 1 mmϕ) cut in a length of about 100 mm were inserted through each of the slots and were then bent over. The 28 sample filaments, in total, were hence positioned in two groups on both sides of the disk respectively and were separately fastened by SUS-316 wires 4 by way of their corresponding holes 5 so as to fix them on the disk. The sample filaments were cut off at a length of 40 mm ($d_1$) from the periphery of the disk. Thereafter, an SUS-316 plate 6 of 160 mm long, 30 mm wide and 1.5 mm thick was vertically fixed at an interval of 35 mm ($d_2$) from the periphery of the disk. In the above arrangement, the disk was rotated at 1,000 rpm and room temperature for 24 hours. The number of broken filaments among the 28 sample filaments was then counted to calculate a broken loss percentage. Each sample was measured three times. The largest and smallest values of the measurement results will be indicated.

Polishing Degree

Measuring Apparatus

Figure 2:
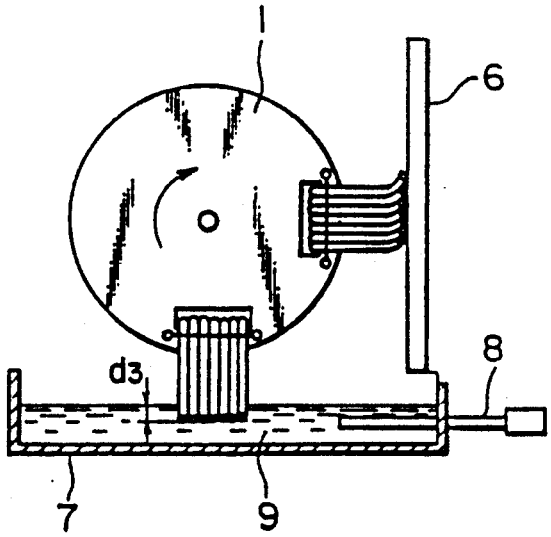
FIG. 2 is a simplified schematic view of an apparatus adapted to determine the polishing degree achieved by abrasive filaments.

Reference is now had to FIG. 2. Underneath the apparatus shown in FIG. 1 and adapted to determine broken loss percentages, was provided a box 7 made of SUS-316 and containing water of 60° C. (Incidentally, the locations of sample filaments mounted on the disk 1 are apart angularly over 90 degrees in FIG. 2 in order to show that the sample filaments abrade, smoothen and polish the plate 6 and their tip portions are then dipped into the water. Needless to say, they may be provided on both sides of the disk as depicted in FIG. 1.)

Measuring Method

In the measuring apparatus of FIG. 1, the box 7 made of SUS-316 was provided at such a position that the sample filaments are immersed to a depth of 10 mm ($d_3$) in water of 60° C. which was heated by a pipe heater 8 (100 V×200 W). Except for the foregoing, the disk 1 was rotated at 1,000 rm for 24 hours in the same manner as in the measuring method for broken loss percentages. The SUS-316 plate 6 was weighed both before and after the polishing work. The weight difference was recorded as a polishing degree. The term "polishing degree" as used herein means the difference in weight between an SUS-316 plate before its polishing and the same plate after its polishing. Each sample was measured three times. The largest and smallest values of the measurement results will be indicated.

Extrudability, Spinnability, Stretchability

The extrudability, spinnability and stretchability of each PVDF resin, which indicate the formability and processability of the PVDF resin, were ranked in three stages, i.e., ○: good, Δ: fair, and ×: poor.

Extrudability:

Good: An extrudate was good in both surface smoothness and uniformity of filament diameter.

Fair: An extrudate was fair in both surface smoothness and uniformity of filament diameter.

Poor: An extrudate was poor in both surface smoothness and uniformity of filament diameter.

Spinnability:

Good Smooth take-up was feasible.

Fair: A gentle and careful take-up operation was needed.

Poor: Filament breakage tended to occur upon taking-up.

Stretchability:

Good: Smooth and high draw-ratio stretching was feasible.

Fair: There was a need to control both draw ratio and drawing temperature extremely low.

Poor: Filaments were susceptible to end breakage upon stretching.

EXAMPLE 1 AND COMPARATIVE EXAMPLE 1

With 90 vol.% of a polymer blend (inherent viscosity: 1.20) which had been obtained by mixing 70 parts by weight of a high melting-point polyvinylidene fluoride homopolymer (inherent viscosity: 1.30; melting point: 178° C.) with 30 parts by weight of a low melting-point polyvinylidene fluoride copolymer (copolymer of 96 mole % of vinylidene chloride and 4 mole % of ethylene tetrafluoride; inherent viscosity: 1.00; melting point: 166° C.), were mixed 10 vol.% of #100 SiC particles coated with 1.0 part by weight of a coupling agent (3-aminopropyltriethoxysilane), followed by pelletization. The resultant pellets were subjected to melt-spinning at 260° C. Filaments thus formed were cooled in warm water of 50° C. and then, continuously stretched 4.0 times in a glycerin bath heated at 165° C., followed by 5% relaxation heat treatment (thermal fixing) in boiling water to obtain filaments (i.e., bristles) having a diameter of 1 mmϕ. Although the filaments contained fine voids, they were tough filaments.

As a Comparative Example, 100 parts of "nylon 6" having a relative viscosity of 3.2 (as measured in accordance with JIS K6810-1977) were added with #100 SiC particles, which were of the same kind as those employed above, in such an amount that the SiC particles reached amounted to 10 vol.%. The resultant mixture was pelletized. Pellets thus obtained were thereafter subjected to melt-spinning at 270° C., cooled in water, and then stretched 3.0 times in a hot water bath of 95° C., whereby filaments (i.e., bristles) having a diameter of 1 mmϕ were obtained.

With respect to those bristles, (1) acid resistance, (2) repeated flexural fatigue (broken loss percentage) and (3) polishing degree (in warm water) were measured. Results will be summarized in Table 1.

Regarding the acid resistance, each bristle sample was immersed in an acidic aqueous solution under conditions to be shown in Table 1 and the time was measured until the bristles was deformed or broken.

Both bristle samples were good in formability and processability such as extrudability, spinnability and stretchability and no particular differences were observed therebetween. However, the conventional nylon-made polyamide-type abrasive filaments were extremely poor in acid resistance and moreover had a high broken loss percentage (repeated flexural fatigue resistance), so that they were inferior in durability. In contrast, the abrasive filaments according to the present invention, which was made of the PVDF resin, were excellent in acid resistance, had a low broken loss percentage and moreover gave a great polishing degree, so that they exhibited superb abrasiveness.

TABLE 1

| | Acid resistance (expressed in terms of days during which the bristle shape was retained successfully in an acidic aqueous water) | | | Repeated flexural fatigue resistance (broken loss percentage) (drying time: 24 hours) | Polishing degree (60° C., in warm water) |
|---|---|---|---|---|---|
| | 90° C. 8% $H_2SO_4$ | 60° C. 6% $HNO_3$ | 80° C. 6% HCl | | |
| Ex. 1 | >39 days | >30 days | >30 days | 0% | 0.06–0.10 g |
| Comp. Ex. 1 | <½ day | <1 day | <1 day | 10–50% | 0.005–0.02 g |

EXAMPLES 2-5 AND COMPARATIVE EXAMPLES 2-4

Filament (bristle) samples were separately produced in the same manner as in Example 1 except for the use of high melting-point vinylidene fluoride homopolymers having a melting point of 178° C. and inherent viscosities varied as will be shown in Table 2. On each bristle sample, the formability and processability such as extrudability, spinnability and stretchability, repeated flexural fatigue and polishing degree were measured. Results will also be summarized in Table 2.

As will become apparent from Table 2, the filaments of Comparative Example 2 in which a PVDF resin having an inherent viscosity as low as 0.8 was used were inferior in repeated flexural fatigue resistance. On the other hand, the filaments of Comparative Example 3 in which a PVDF resin having a high inherent viscosity was used were inferior in extrudability and spinnability. In contrast, the filaments obtained separately in the Examples of this invention in which PVDF resins having an inherent viscosity in a range of 0.9–1.3 were used respectively were highly balanced in formability, durability and abrasiveness.

EXAMPLES 6-10

Filament (bristle) samples were produced separately in the same manner as in Example 1 except that a polyvinylidene fluoride homopolymer (inherent viscosity: 1.30; melting point: 178° C.) and a copolymer (inherent viscosity: 1.10; melting point: 160° C.) of vinylidene fluoride (93.5 mole %) and propylene hexafluoride (6.5 mole %) were blended respectively as a high melting-point PVDF resin and a low melting-point PVDF resin in proportions to be shown in Table 3.

Measurement results of their physical properties will also be shown in Table 3.

As will be envisaged from Table 3, blending of a low melting-point PVDF resin can improve the formability and processability. In addition, the broken loss percentage can also be reduced. If the proportion of such a low melting-point PVDF resin should increase to 60–80 parts by weight, there is a tendency that more voids would be formed and the external appearance of resultant filaments would be deteriorated. Even those containing the low melting-point PVDF resin in higher proportions still had excellent abrasiveness, acid resistance and durability when compared to conventional polyamide-base abrasive filaments.

TABLE 2

| | Melting point (°C.) | Inherent viscosity ($\eta_{inh}$) | Abrasive grains SiC (#60) (vol. %) | Extrudability | Spinnability | Stretchability | Repeated flexural fatigue (broken loss percentage) (%) | Polishing degree (g) |
|---|---|---|---|---|---|---|---|---|
| Comp. Ex. 2 | 178 | 0.80 | 10 | ○ | ○ | ○ | 40–70 | 0.005–0.08 |
| Ex. 2 | 178 | 0.90 | 10 | ○ | ○ | ○ | 0–35 | 0.01–0.10 |
| Ex. 3 | 178 | 1.00 | 10 | ○ | ○ | ○ | 0–20 | 0.02–0.10 |
| Ex. 4 | 178 | 1.10 | 10 | ○ | ○ | ○ | 0–15 | 0.03–0.11 |
| Ex. 5 | 178 | 1.30 | 10 | ○-Δ | ○-Δ | ○ | 0 | 0.04–0.12 |
| Comp. Ex. 3 | 178 | 1.50 | 10 | X | X | ○ | — | — |
| Comp. Ex. 4 | 178 | 1.70 | 10 | X | X | ○ | — | — |

○: Good,
Δ: Fair,
X: Poor.

TABLE 3

| | Example 6 | Example 7 | Example 8 | Example 9 | Example 10 |
|---|---|---|---|---|---|
| PVDF Resin | | | | | |
| Homopolymer (wt. parts) Inherent viscosity: 1.30 Melting point: 178° C. | 100 | 80 | 60 | 40 | 20 |
| Copolymer (wt. parts) Inherent viscosity: 1.10 Melting point: 160° C. | 0 | 20 | 40 | 60 | 80 |
| Inherent viscosity of blend | 1.30 | 1.26 | 1.20 | 1.17 | 1.14 |
| Abrasive grains | | | | | |
| SiC (#100), vol. % | 10 | 10 | 10 | 10 | 10 |
| Silane coupling agent, vol. % | 1 | 1 | 1 | 1 | 1 |
| Extrudability | Δ-○ | ○ | ○ | ○ | ○ |
| Spinnability | Δ-○ | ○ | ○ | ○ | ○ |
| Stretchability | ○ | ○ | ○ | ○ | ○ |

TABLE 3-continued

| | Example 6 | Example 7 | Example 8 | Example 9 | Example 10 |
|---|---|---|---|---|---|
| Repeated flexural fatigue (broken loss percentage) | 0 | 0 | 0 | 0–15 | 10–20 |
| Polishing degree (g) | 0.04–0.12 | 0.03–0.10 | 0.02–0.08 | 0.008–0.04 | 0.006–0.03 |
| Formation of voids (external appearance) | few | few | few | many | many |

○: Good,
Δ: Fair.

EXAMPLES 11-15

Filament (bristle) samples were produced separately in the same manner as in Example 1 except that a high melting-point polyvinylidene fluoride homopolymer (inherent viscosity: 1.30; melting point: 178° C.) and as a low melting-point PVDF resin, a copolymer (inherent viscosity: 1.07; melting point: 166° C.) of vinylidene fluoride (95 mole %) and propylene hexafluoride (5 mole %) were blended in proportions to be shown in Table 4.

Measurement results of physical properties of the bristle samples will also be shown in Table 4.

As will become apparent from Table 4, the formability and processability will be improved as the proportion of a low melting-point PVDF resin increases. However, any proportion of a low melting-point PVDF resin greater than 50 wt.% tends to result in filaments containing more voids and reduced external appearance.

TABLE 4

| | Example 11 | Example 12 | Example 13 | Example 14 | Example 15 |
|---|---|---|---|---|---|
| PVDF Resin | | | | | |
| Homopolymer (wt. parts) Inherent viscosity: 1.30 Melting point: 178° C. | 80 | 60 | 50 | 40 | 20 |
| Copolymer (wt. parts) Inherent viscosity: 1.07 Melting point: 166° C. | 20 | 40 | 50 | 60 | 80 |
| Inherent viscosity of blend | 1.24 | 1.19 | 1.17 | 1.16 | 1.12 |
| Abrasive grains (vol. %) SiC (#100) | 10 | 10 | 10 | 10 | 10 |
| Extrudability | Δ-○ | ○ | ○ | ○ | ○ |
| Spinnability | Δ-○ | ○ | ○ | ○ | ○ |
| Stretchability | ○ | ○ | ○ | ○ | ○ |
| Repeated flexural fatigue (broken loss percentage) | 0 | 0 | 0 | 0–5 | 10–10 |
| Polishing degree (g) | 0.04–0.10 | 0.03–0.08 | 0.02–0.07 | 0.008–0.05 | 0.006–0.04 |
| Formation of voids (external appearance) | few | few | few | many | many |

○: Good,
Δ: Fair.

EXAMPLE 16

Mixed were 60 parts by weight of a high melting-point polyvinylidene homopolymer (inherent viscosity: 1.20; melting point: 178° C.) and as a low melting-point PVDF resin, 40 parts by weight of a copolymer (inherent viscosity: 1.00; melting point: 168° C.) of vinylidene fluoride (96 mole %) and propylene hexafluoride (4 mole %). The inherent viscosity of the resultant polymer blend was 1.12. In methanol, a coupling agent (3-glycidoxypropylmethoxysilane) and SiC (#200) were mixed and stirred in an amount of 1 part by weight per 100 parts by weight of the PVDF resin and in an amount of 10 vol.% based on 90 vol.% of the PVDF resin respectively. The resultant mixture was then dried. The PVDF resin and the thus-dried mixture of the SiC and coupling agent were mixed and agitated in a Henschel mixer. The resultant mixture was then pelletized and in exactly the same manner as in Example 1, filaments (bristles) were obtained. Physical properties of the bristles were measured. The following results were obtained.

Extrudability: Good.
Spinnability: Good
Stretchability: Good.
Repeated flexural fatigue (broken loss percentage): 0%
Polishing degree: 0.03–0.08 g.

As has been demonstrated above, filaments according to this invention are excellent in formability, processability, durability and abrasiveness.

What is claimed is:

1. Abrasive filaments made of a composition which comprises 95–70 vol.% of a polyvinylidene fluoride resin, whose inherent viscosity ($\eta_{inh}$) ranged from 0.9 to 1.4, and 5–30 vol.% of abrasive grains, wherein the polyvinylidene fluoride resin is a polymer blend composed of a high melting-point polyvinylidene fluoride resin whose melting point ($T_{m1}$) ranges from 165° C. to 185° C. and a low melting-point polyvinylidene fluoride resin whose melting point ($T_{m2}$) ranges from m125° C. to 170° C., and the melting points ($T_{m1}$), ($T_{m2}$) satisfy the following equation:

$$, 50^\circ C. \geqq (T_{m1} - T_{m2}) \geqq 5^\circ C.$$

2. The abrasive filaments as claimed in claim 1, wherein the polymer blend is composed of less than 100 wt.% but not less than 20 wt.% of the high melting-point point polyvinylidene fluoride resin and greater than 0 wt.% but not greater than 80 wt.% of the low melting-point polyvinylidene fluoride resin.

3. The abrasive filaments as claimed in claim 1, wherein the polymer blend is composed of 99 wt.%–50 wt.% of the high melting-point polyvinylidene fluoride resin and 1 wt.%-50 wt.% of the low melting-point polyvinylidene fluoride resin.

4. The abrasive filaments as claimed in claim 1, wherein the polymer blend is composed of 80 wt.%-55 wt.% of the high melting-point polyvinylidene fluoride resin and 20 wt.%-50 wt.% of the low melting-point polyvinylidene fluoride resin.

5. The abrasive filaments as claimed in claim 1, wherein the melting points $(T_{m1})$,$(T_{m2})$ satisfy the following equation:

$$40^\circ\ C. \geqq (T_{m1}-T_{m2}) \geqq 10^\circ\ C.$$

* * * * *